US007331459B2

(12) United States Patent
Hilbourne

(10) Patent No.: US 7,331,459 B2
(45) Date of Patent: Feb. 19, 2008

(54) CONNECTIBLE PIZZA SPACER

(76) Inventor: Jason Hilbourne, 320 SW. Stark St., #510, Portland, OR (US) 97204

( * ) Notice: Subject to any disclaimer, the term of this patent is extended or adjusted under 35 U.S.C. 154(b) by 541 days.

(21) Appl. No.: 10/921,423

(22) Filed: Aug. 17, 2004

(65) Prior Publication Data

US 2006/0037885 A1 Feb. 23, 2006

(51) Int. Cl.
*B65D 85/30* (2006.01)
*B65D 5/50* (2006.01)
*B65D 85/36* (2006.01)
*B65D 81/50* (2006.01)

(52) U.S. Cl. ..... 206/525; 229/199; 229/906; 426/115; 426/124; 206/541; D7/601

(58) Field of Classification Search ..... 206/551, 206/525; 229/199, 116.1; D9/499, 434, D9/456; 426/115, 124
See application file for complete search history.

(56) References Cited

U.S. PATENT DOCUMENTS 3,100,459 A * 8/1963 Liss et al. ..... 108/91
4,498,586 A 2/1985 Vitale ..... 206/525
D299,773 S * 2/1989 Kracke ..... D34/7
5,077,050 A * 12/1991 Wall ..... 426/124
5,173,070 A 12/1992 Gould ..... 446/79
5,366,144 A * 11/1994 Eisman ..... 229/199
5,509,601 A * 4/1996 Drabick ..... 229/199
5,516,036 A * 5/1996 Maultasch et al. ..... 229/125.39
D380,792 S * 7/1997 Gabriel ..... D21/489
6,332,533 B1 * 12/2001 Howisen ..... 206/307.1
6,439,529 B1 8/2002 Wong ..... 248/346.01
6,803,552 B1 * 10/2004 Irizarry et al. ..... 219/732

* cited by examiner

*Primary Examiner*—Jila M Mohandesi
(74) *Attorney, Agent, or Firm*—Marger Johnson & McCollom, P.C.

(57) ABSTRACT

According to embodiments of the invention, the secondary usefulness of a pizza spacer is increased by providing a coupling mechanism that is configured to attach the pizza spacer to other pizza spacers in order to form larger objects that have a purpose beyond that of merely functioning as a pizza spacer. For example, a pizza spacer according to some embodiments of the invention may be connected to other pizza spacers to complete a jigsaw puzzle. Other embodiments of the invention are described and claimed.

18 Claims, 2 Drawing Sheets

CONNECTIBLE PIZZA SPACER

BACKGROUND OF THE INVENTION

1. Field of the Invention

This disclosure relates to pizza-box lid support devices, and more particularly, to improved pizza-box lid support devices that have improved secondary uses.

2. Description of the Related Art

Pizza-box lid support devices, also known as pizza spacers and package savers, do a good job of keeping pizza cheese and toppings off of the pizza-box lid. However, after the consumer opens the pizza-box to enjoy his pizza, the plastic pizza spacer-like the one described in U.S. Pat. No. 4,498,586 to Vitale ("Vitale")—is typically thrown into the trash. Because the small pizza spacers are perceived as disposable items, consumers don't think twice about throwing them away. This is a problem because it creates a lot of waste. One tiny pizza spacer seems insignificant when compared to the size of a landfill. However, when you consider that more than six hundred million pizzas are delivered every year, the problem becomes more apparent.

Solutions to the waste problem include reducing the size of the device, using more environmentally friendly materials (i.e., biodegradable materials) for the device, recycling the device, and creating a secondary use for the device.

These solutions have their own drawbacks. For example, a smaller device will not work as well as the currently accepted size. Additionally, the materials used to manufacture conventional pizza spacers are typically the cheapest available that meet the requirements for the device—temperature resistance and fracture resistance. Recycling pizza spacers is also problematic because the curb-side recycling programs that are implemented in most cities will only pick up plastic containers—forcing consumers to choose between the trash and driving to a specialized recycling center. Given the above problems associated with other solutions, creating additional secondary uses for the device seems to be the best way to address the waste problem presented by disposable pizza spacers.

One example of a secondary use for the pizza spacer can be found in U.S. Pat. No. 5,173,070 to Gould ("Gould"). After its life as a pizza spacer, the device converts into a child's toy. This pizza spacer features a small flying disc that can be torn away from the device—providing children with a tiny toy that they can play with after eating the pizza. While this is a step in the right direction, the device's legs are still wasted in the process, and the toy itself is also of transient play value—it is quickly discarded.

Another example of a secondary use for the pizza spacer would be to use it as a marketing tool for pizzerias. There is little differentiation among the many configurations of pizza spacers that are currently manufactured. Some are shaped like tiny discs. Others are triangular. However, none of them are distinctive enough that they would be readily associated with a particular pizzeria. Marking a pizza spacer with a pizzeria's name and telephone number is an obvious marketing tool. However, it would be counterproductive to place a phone number on a disposable item. The flying disc pizza spacer is highly differentiated from the other pizza spacers currently manufactured, but its disposable nature also hinders its impact as a marketing tool.

Embodiments of the invention address these and other disadvantages of the conventional art.

DETAILED DESCRIPTION OF THE INVENTION

According to embodiments of the invention, a pizza spacer may be detachably linked to other similar pizza spacers in novel ways to increase the secondary usefulness of the pizza spacer. In the following detailed description, numerous exemplary embodiments of the invention will be described with reference to the attached FIGURES. Although the specification below may refer to "an", "one", "another", or "some" embodiment(s) in several locations, this does not necessarily mean that each such reference is to the same embodiment(s), or that the feature described only applies to a single embodiment.

According to some embodiments of the invention, a connectible pizza spacer consists of a horizontal member that is supported by multiple legs. Preferably, the connectible pizza spacer is fabricated by an injection-molding process. The connectible pizza spacer may be economically molded from any color of heat-resistant plastic resin which will readily withstand temperatures as high as 450 degrees F. This heat-resistance feature is particularly important in packaging pizza.

Figure 1:
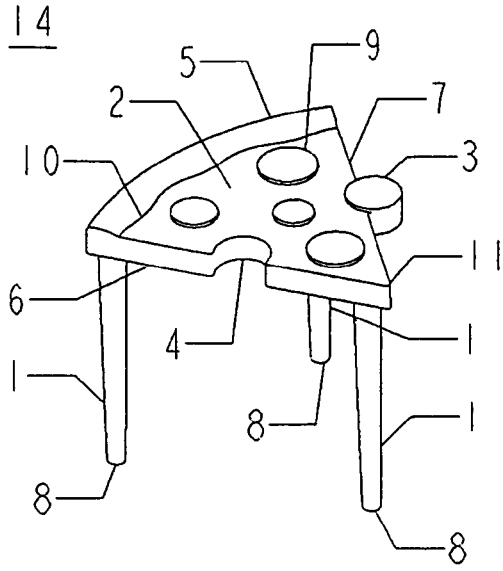
FIG. 1 is a perspective diagram illustrating a connectible pizza spacer according to some embodiments of the invention.
Figure 2:
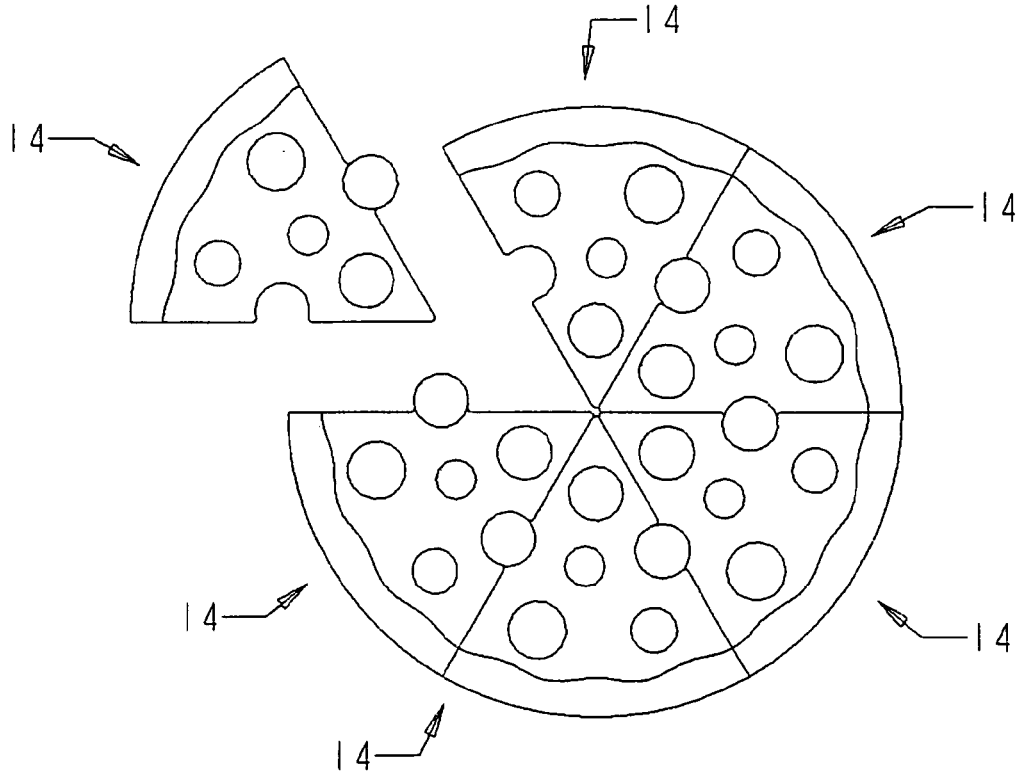
FIG. 2 is a plan diagram illustrating a number of the connectible pizza spacers of FIG. 1 linked together.
Figure 3:
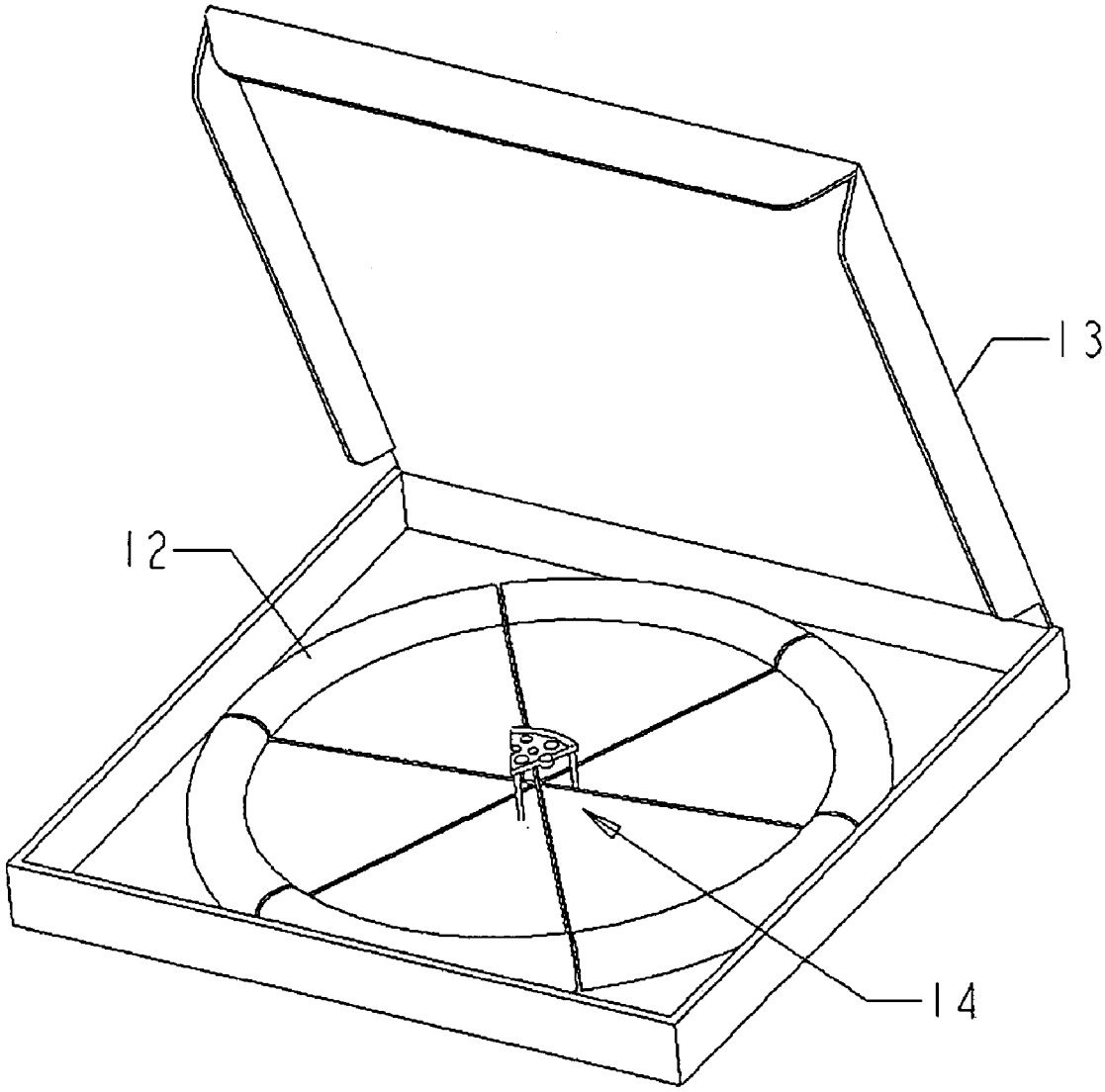
FIG. 3 is a perspective diagram illustrating the connectible pizza spacer of FIG. 1 in a pizza-box.

FIG. 1 is a perspective diagram illustrating a connectible pizza spacer according to some embodiments of the invention. FIG. 2 is a plan diagram illustrating a number of the connectible pizza spacers of FIG. 1 linked together. FIG. 3 is a perspective diagram illustrating the connectible pizza spacer of FIG. 1 in a pizza-box.

Referring to FIGS. 1-3, a shelf 2 of the connectible pizza spacer 14 includes a shelf 2 with three legs of 1 of equal length. According to these embodiments, the shelf 2 is molded to appear as a sixty degree slice of pizza. The shelf 2 is generally horizontally disposed for contact with the underside of a pizza-box lid 13. The relatively flat shelf 2 is sufficiently broad to distribute the effect of top loading of the pizza-box 13 lid.

The shelf 2 includes molded features such as toppings 9 and crust 10 to enhance the resemblance of the connectible pizza spacer 14 to an actual slice of pizza. The raised profile of the toppings 9 and crust 10 is small enough so that it will not interfere with the top loading distribution effect between the pizza-box 13 lid and the shelf 2.

The connectible pizza spacer 14 has three circular legs 1 of equal length. Other embodiments of the invention may have more than three legs, or have legs having a different shape. Each leg 1 and foot 8 has a relatively small diameter to minimize disturbance or marking of the pizza 12 when the pizza is packaged in a pizza-box 13. The legs 1 project perpendicularly downward from the plane of the shelf 2. One of the legs is located near a tip 11 of the shelf and the other two of the legs 1 are located near the ends of an outside arc 5.

The connectible pizza spacer 14 also includes a male connector 3 that projects out of a male side 7 of the shelf 2, the male connector being coplanar with the shelf. The connectible pizza spacer 14 also includes a female connector 4 that is a space cut out of a female side 6 of the shelf 2. As shown in FIG. 2, the radii and position of the male connector 3 and the female connector 4 are designed so that they will fit together snugly—like puzzle pieces—when connected to other connectible pizza spacers 14. In the embodiments described above, the male connector 3 has the same shape as the other toppings 9. However, the shape of the male connector 3 and the female connector 4 may be shaped differently.

The primary use for the connectible pizza spacer 14 is illustrated in FIG. 3. The connectible pizza spacer 14 is placed on the center of the pizza 12 so that the shelf 2 supports the underside of the pizza-box 13 lid when the pizza-box 13 is closed. The relatively flat shelf 2 is sufficiently broad to distribute the effect of top loading of the pizza-box 13 lid. The primary use for the connectible pizza spacer 14 is to prevent the pizza-box 13 lid from touching the pizza 12 toppings when other objects or forces are loaded on top of the pizza-box 13. Thus, the primary use of the connectible pizza spacer 14 as shown in FIG. 3 does not depart significantly from that of other conventional pizza spacers.

However, the secondary usefulness of the connectible pizza spacer 14 is what differentiates it from the conventional pizza spacers. Two or more connectible pizza spacers 14 may be linked together by snapping the male connector 3 from one connectible pizza spacer 14 to the female connector 4 of another connectible pizza spacer 14. When six connectible pizza spacers 14 are linked together, as shown in FIG. 2, the collection of connectible pizza spacers 14 looks like an entire tiny pizza. The resulting tiny pizzas may also be stacked vertically into a tower configuration.

The secondary use that makes the connectible pizza spacer 14 connectible is also what makes the device collectable. Because of the puzzle-piece metaphor and the resemblance to a slice of pizza, it will become obvious to consumers that they can eventually build an entire tiny pizza by collecting six of the devices. For many people, this will create a desire to collect five more connectible pizza spacers 14. This will result in customer loyalty, repeat business, and increased sales for pizzerias.

Beyond the fun of simply collecting connectible pizza spacers 14 to create personal collections, the devices could also be used by pizzerias as a customer loyalty redemption promotion in place of punch cards or stamp cards. A simple redemption promotion might involve redeeming a completed tiny pizza collection to receive a coupon for a free small pizza. Another redemption promotion might involve distinctly colored connectible pizza spacers 14 that would be distributed through pizza delivery boxes at random. Redeeming a completed tiny pizza collection that features a particularly colored connectible pizza spacer 14 would entitle the consumer to a special reward.

The embodiments of the invention described above, that is, a connectible pizza spacer 14 shaped like a 60 degree slice of pizza, is just one example of a shape that could be used. In other embodiments, the connectible pizza spacer may be shaped like a 360 degree, 180 degree, 120 degree, 90 degree, 72 degree, 45 degree, 36 degree slice of pizza, or any other convenient size. It should be apparent that given the plethora of shapes that may be easily manufactured, other connectible pizza spacers 14 according to other embodiments of the invention may have a multitude of different shapes that are combinable with other connectible pizza spacers to form a larger shape. Connectible spacers each having the same shape or each having a different shape may be connected.

The invention may be practiced in many ways. What follows are exemplary, non-limiting descriptions of some embodiments of the invention.

According to embodiments of the invention, a connectible pizza spacer may have a horizontal member of any shape. For instances, possible shapes includes a circle, a sector of the circle, a polygon (such as a triangle, a rectangle, a pentagon, a hexagon, a septagon, an octagon, a nonagon, a decagon, etc.,), a puzzle shape, an irregular shape, etc. According to embodiments of the invention, a connectible pizza spacer has at least one male connector and at least one female connector so that the connectible pizza spacer may be horizontally connected to another connectible pizza spacer. The other connectible pizza spacer need not be exactly the same as the first connectible spacer, for example, in the case where one connectible pizza spacer represents one piece of a puzzle and a second connectible pizza spacer represents a second piece of a puzzle.

According to some embodiments of the invention, the male connector may be a protrusion that is coplanar with the horizontal member. The female connector may be an indentation in the horizontal member that matches the shape of the male connector. The connectible pizza spacer could be any shape that fits together using locking tabs or a puzzle shape or any mechanical means of locking two shapes together.

According to other embodiments of the invention, the connectible pizza spacer may also be configured to be stacked in the vertical direction along with other connectible pizza spacers. This stacking could be facilitated by creating tight holes in the shelf 2 that would lock onto the feet 8 of another connectible pizza spacer when stacked vertically. These holes may be blind holes to allow tall stacking. This is opposite to the intent of the conventional art disclosed by U.S. Pat. No. 6,439,529 to Wong ("Wong"), which has through holes to allow the shortest and most efficient possible stacking.

According to some embodiments of the invention, a connectible pizza spacer may have more than three legs. Embodiments of the invention may also have legs of different heights, shapes, and sizes.

According to different embodiments of the invention, a connectible pizza spacer may be customized with a pizzeria's name, phone number, graphics, and/or logo by laser-engraving, hot-stamping, pad-printing, or as part of the plastic part, etc.

According to other embodiments of the invention, a connectible pizza spacer may also be designed as any shape meant to be collected in conjunction with other connectible pizza spacers to create another, larger shape or design. For example, puzzles that incorporate company logos, letters, numbers, animals, cartoon characters, etc., may be used.

According to different embodiments of the invention, a connectible pizza spacer may be molded in different colors and color schemes. For example, they could be shipped all white, or all green, or all red; and they could also be shipped as a mixture of those three colors for an Italian flag theme. In alternative embodiments, a connectible pizza spacer may be made from temperature-sensitive color-shifting plastic. It would serve as an indicator to let consumers know that their pizza is still hot after delivery.

According to embodiments of the invention, a connectible pizza spacer may have a secondary use as, for instance, part of a puzzle, part of a child's toy, part of an advertisement, part of a promotional incentive, and part of a beverage coaster. A connectible pizza spacer that is used as part of a promotional incentive may be especially effective in creating a secondary use for the connectible pizza spacer that prevents it from being thrown away.

Having described several exemplary embodiments of the invention, it should be apparent that modifications and variations of the described embodiments will be obvious to those of skill in the art that do not depart from the inventive concepts disclosed above. Consequently, the scope of the invention should not be limited to only those embodiments described above, but to all embodiments as defined and encompassed by the attached claims.

I claim:

1. A pizza spacer comprising:

a member aligned substantially in a plane, the member having a connector, the connector configured to attach to another pizza spacer such that the member of the pizza spacer and a member of the another pizza spacer are aligned substantially in the plane, wherein a side of the member comprises an arc and the member comprises a plurality of raised molded features; and at least three circular legs protruding from the member in a direction perpendicular to the plane, where a height of the legs is larger than a thickness of the member and where the pizza spacer is configured to engage with a pizza and thereby support a lid of a pizza box, wherein the pizza spacer is configured to engage with a plurality of other pizza spacers such that the pizza spacer and the plurality of other pizza spacers form a circle.

2. The pizza spacer of claim 1, the connector comprising a male connector configured to couple to a female connector of the another pizza spacer.

3. The pizza spacer of claim 1, the connector comprising a female connector configured to couple to a male connector of the another pizza spacer.

4. The pizza spacer of claim 1 the member substantially shaped like a sector of the circle.

5. The pizza spacer of claim 1, the member substantially shaped like a puzzle piece.

6. The pizza spacer of claim 1, the pizza spacer composed of a temperature-sensitive, color-shifting plastic.

7. A pizza spacer comprising:

a first support having a physical size along an x-axis and a y-axis that is large compared to a physical size along a z-axis, the x-axis, the y-axis, and the z-axis being mutually orthogonal;

at least three circular legs of equal height protruding from a lower surface of the first support and aligned parallel to the z-axis, where the height of the legs is greater than the physical size of the first support along the z-axis, wherein a side of the first support comprises an arc and the first support comprises a plurality of raised molded features; and a coupling configured to attach the first support to a second support of another pizza spacer such that the first support and second support are held adjacent to each other in a plane defined by the x-axis and the y-axis, where the pizza spacer is configured to engage with a pizza and thereby support a lid of a pizza box, wherein the pizza spacer is configured to engage with a plurality of other pizza spacers such that the pizza spacer and the plurality of other pizza spacers form a circle.

8. The pizza spacer of claim 7, wherein the coupling is an integral part of the first support.

9. The pizza spacer of claim 8, wherein the coupling comprises a male connector configured to attach to a female connector of the second support.

10. The pizza spacer of claim 8, wherein the coupling comprises a female connector configured to attach to a male connector of the second support.

11. The pizza spacer of claim 7, the first support comprising at least three blind holes in an upper surface thereof, the blind holes configured to hold at least three legs from another pizza spacer.

12. The pizza spacer of claim 9, the first support shaped substantially like a slice of pizza.

13. The pizza spacer of claim 12, the male connector shaped substantially like a pizza topping.

14. A pizza spacer comprising:

a shelf, the shelf including a male connector extending train a first side of the shelf and a female connecter disposed on a second side of the shelf, wherein a side of the shelf comprises an arc and the shelf comprises a plurality of raised molded features;

a plurality of circular legs extending substantially perpendicularly from a bottom of the shell, the legs having a substantially equal length, wherein the length of the legs is larger than a thickness of the shelf, wherein the shelf is configured to be detachably affixed to another shelf of another pizza spacer such that the shelf and the another shelf are disposed in substantially the same plane and wherein the pizza spacer is configured to engage with a pizza and thereby support a lid of a pizza box, and wherein the pizza spacer is configured to engage with a plurality of other pizza spacers such that the pizza spacer and the plurality of other pizza spacers form a circle.

15. The pizza spacer of claim 14, the shelf configured to form a part of a puzzle, a part of a child's toy, a part of an advertisement, a part of a promotional incentive, or a part of a beverage coaster.

16. The pizza spacer of claim 14, wherein the pizza spacer is composed of injection-molded plastic.

17. The pizza spacer of claim 14, wherein the plurality of raised molded features comprises a plurality of pizza-topping-shaped molded features, and the male connector is pizza-topping-shaped.

18. The pizza spacer of claim 14, wherein the shelf is configured to be mechanically locked to the another shelf.

* * * * *

UNITED STATES PATENT AND TRADEMARK OFFICE

CERTIFICATE OF CORRECTION

PATENT NO. : 7,331,459 B2
APPLICATION NO. : 10/921423
DATED : February 19, 2008
INVENTOR(S) : Jason Hilbourne It is certified that error appears in the above-identified patent and that said Letters Patent is hereby corrected as shown below:

Column 5, line 35, the words "claim 1" should read -- claim 1, --;
Column 6, line 25, the word "train" should read -- from --;
Column 6, line 30, the word "shell" should read -- shelf --.

Signed and Sealed this

Twenty-seventh Day of October, 2009

David J. Kappos

David J. Kappos
*Director of the United States Patent and Trademark Office*